US005162857A

United States Patent [19]

Higeta et al.

[11] Patent Number: 5,162,857

[45] Date of Patent: Nov. 10, 1992

[54] SHEET CONVEYER HAVING A SHEET ALIGNER

[75] Inventors: Akira Higeta, Yokohama; Toru Kameyama, Tokyo; Takahiro Azeta, Kawasaki; Harukazu Sekiya; Toshifumi Moritani, both of Yokohama; Kenji Baba, Kofu; Kazuyuki Kubota, Yamanashi, all of Japan

[73] Assignees: Canon Kabushiki Kaisha, Tokyo; Nippon Seimitsu Kogyo Kabushiki Kaisha, Yamanashi, both of Japan

[21] Appl. No.: 642,149

[22] Filed: Jan. 16, 1991

Related U.S. Application Data

[63] Continuation of Ser. No. 216,499, Jul. 8, 1988, abandoned.

[30] Foreign Application Priority Data

Jul. 14, 1987 [JP] Japan ..... 62-176775
Jul. 14, 1987 [JP] Japan ..... 62-176776
Jul. 14, 1987 [JP] Japan ..... 62-176777

[51] Int. Cl.[5] ..... G03G 15/00

[52] U.S. Cl. ..... 355/309; 355/317; 355/319; 271/3.1; 271/251

[58] Field of Search ..... 355/319, 26, 321, 317; 271/3.1, 225, 248–252, 902

[56] References Cited

U.S. PATENT DOCUMENTS

| | | | |
|---|---|---|---|
| 4,146,219 | 3/1979 | Phillips | 271/902 X |
| 4,334,759 | 6/1982 | Clausing | 355/317 |
| 4,487,506 | 12/1984 | Repp et al. | 355/318 |
| 4,697,911 | 10/1987 | Kajita et al. | 355/319 |
| 4,758,862 | 7/1988 | Fukae et al. | 355/319 |
| 4,763,166 | 8/1988 | Watanabe | 355/322 X |
| 4,823,159 | 4/1989 | Yamamoto et al. | 355/317 |

FOREIGN PATENT DOCUMENTS

| | | | |
|---|---|---|---|
| 54-47659 | 4/1979 | Japan | 355/319 |
| 61-225359 | 11/1986 | Japan | 355/317 |

*Primary Examiner*—Joan H. Pendegrass
*Attorney, Agent, or Firm*—Fitzpatrick, Cella, Harper & Scinto

[57] ABSTRACT

A sheet conveyer having a sheet registration device for an image forming apparatus having a sheet path for guiding a sheet having an image recorded on one side thereof back to an image forming unit for recording another image on the other side, comprises a mechanism for switching the sheet having the image recorded on one side thereof back to the sheet path, a mechanism for abutting the switched-back sheet against a lateral registration reference plane, and a preliminary shift function shared by the switch-back mechanism for shifting the sheet oppositely to the reference plane.

19 Claims, 13 Drawing Sheets

SHEET CONVEYER HAVING A SHEET ALIGNER

This application is a continuation of application Ser. No. 216,499 filed July 8, 1988, now abandoned.

BACKGROUND OF THE INVENTION

1. Field of the Invention

The present invention relates to a sheet conveyer having a sheet aligner or register, and more particularly to a sheet conveyer in an image forming apparatus such as a copying machine or printer. Furthermore, it relates to a sheet conveyer having an aligner for aligning a sheet widthwise before the sheet is guided to an image forming apparatus having a path along which the sheet is reconveyed to an image forming position in a both-surface multiple copy machine.

2. Related Background Art

A prior art apparatus is explained with reference to FIGS. 1A and 1B.

In this apparatus, a sheet is guided along a refeed or reload path in order to form images on front and back surfaces of the sheet.

In FIG. 1B, the sheet having an image recorded on a first surface thereof is fed from the right along an arrow 15, the image is fixed by a fixing unit 3, and the sheet is switched back by rollers 4 and 5 of roller unit 6 and fed along the direction of arrow 18. The sheet is reversed by a refeed path and again guided to the image forming unit where an image is recorded on a second surface The sheet is then ejected to a tray by rollers 4 and 4.

In this apparatus, since the left edge of the print sheet when the print sheet is fed along the direction of arrow 18 and a reference plane of the lateral registration are on the same line, no problem occurs when the sheet skews rightward with respect to the feed direction. However, if the sheet skews leftward even a bit, it abuts against a front plane 14*a* of the lateral registration plate and the sheet may be folded or jam. It may be theoretically possible to feed the print sheet without any skew but it is actually very difficult because very high precision parts are required. As shown in FIGS. 1A and 1B, the prior art apparatus is provided with an preliminary shift mechanism 23 to skew the print sheet oppositely to the lateral registration plate so that the print sheet is offset from the lateral registration plate and in parallel therewith. The print sheet is then caused to abut against the lateral registration plate by skew rollers 7 and 8 for alignment.

In the prior art apparatus, since the preliminary shift mechanism 23 is separately provided between the switch-back mechanism 6 and the skew mechanism 9, the number of parts is considerably large. The overall apparatus is complex and the size of the apparatus must be large because there must be a sufficient spacing to skew the print sheet between the switch-back mechanism and the preliminary shift mechanism, and between the preliminary shift mechanism and the skew roller mechanism. Accordingly, in the prior art apparatus, there are disadvantages of complexity, large size and resulting high cost.

SUMMARY OF THE INVENTION

It is an object of the present invention to provide a preliminary shift mechanism of a simple structure.

In order to achieve the above object, in accordance with the present invention, a roller bearing is designed such that a sheet is fed straight when the roller is rotated in one direction, but when the roller is rotated in the other direction, the shaft is skewed so that the sheet is fed obliquely.

In accordance with a further feature of the present invention, the preliminary shift mechanism is shared by a switch-back mechanism and the bearing described above is used as a reversible roller of the switch-back mechanism.

In accordance with the present invention, the above construction is used for the alignment in a copying machine so that a center reference is aligned to a center reference or the center reference is aligned to a side reference.

In the present apparatus, since the switch-back mechanism is provided with the preliminary shift function to eliminate the preliminary shift mechanism, the path length of the apparatus is significantly reduced and the size, complexity and cost of the apparatus are reduced.

Skew in a reverse feed mode is easily attained by providing a gap in one of the bearings of a center rotation shaft of a follow roller contacting with a drive roller. Thus, a complex and large size link mechanism and means for controlling and driving the link mechanism can be eliminated and the cost is reduced.

DETAILED DESCRIPTION OF THE PREFERRED EMBODIMENTS

Figure 1A:
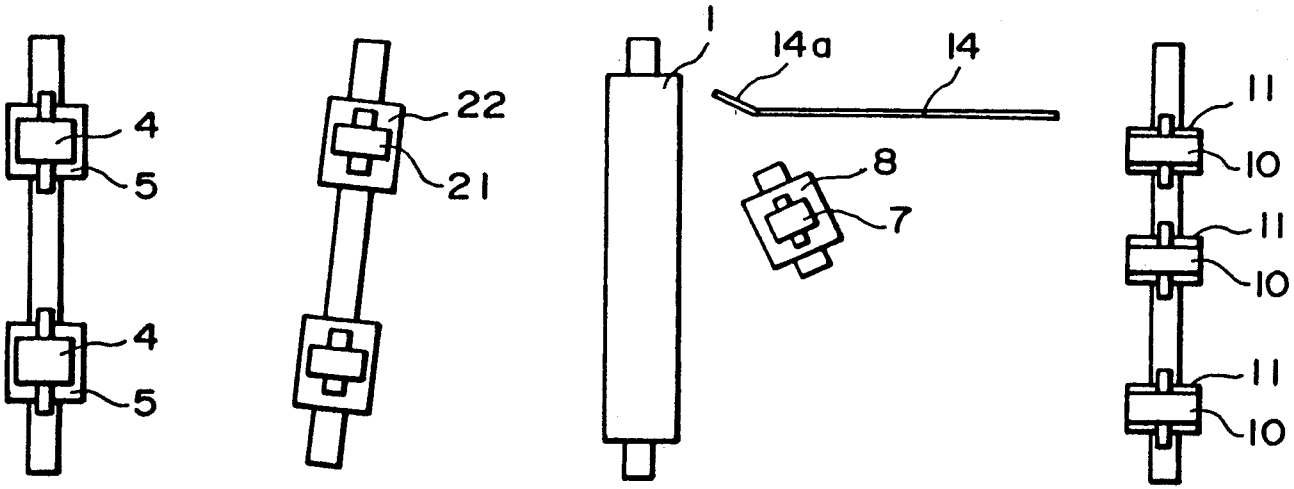
FIG. 1A PRIOR ART
FIGS. 1A and 1B show a plan view and a front view of a prior art apparatus.
Figure 1B:
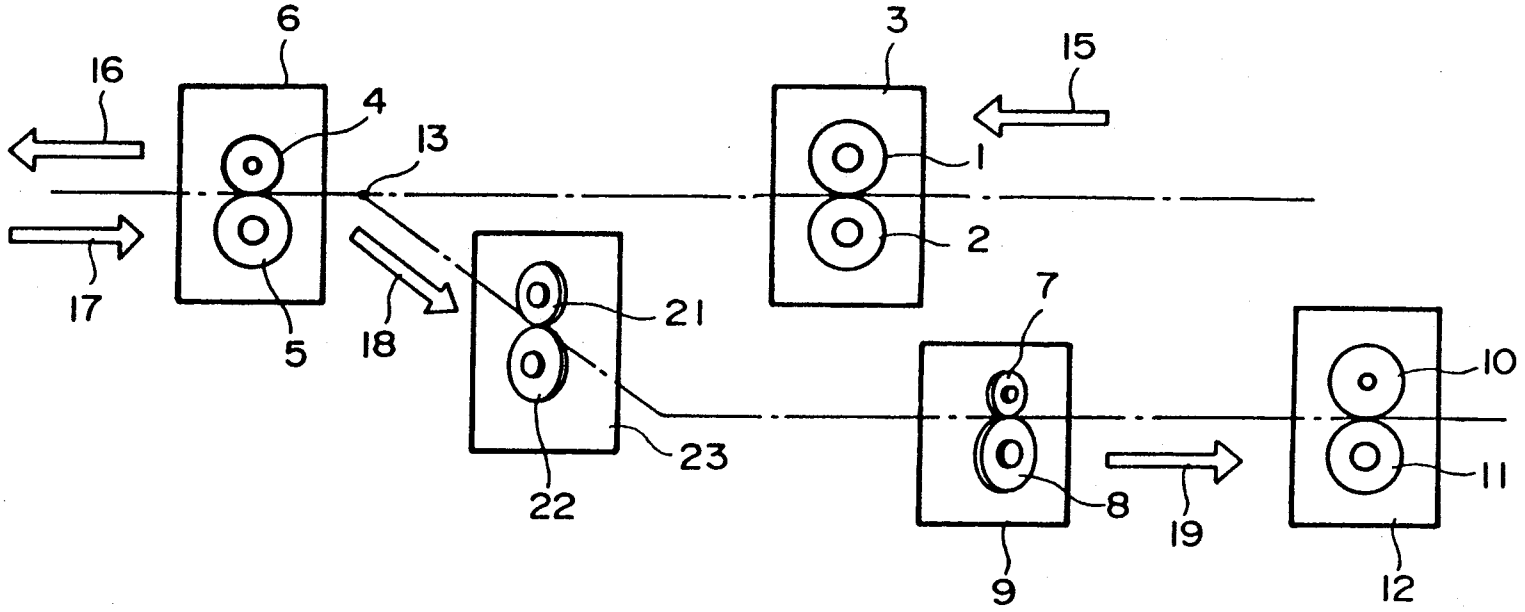
FIG. 1B PRIOR ART
Figure 2A:
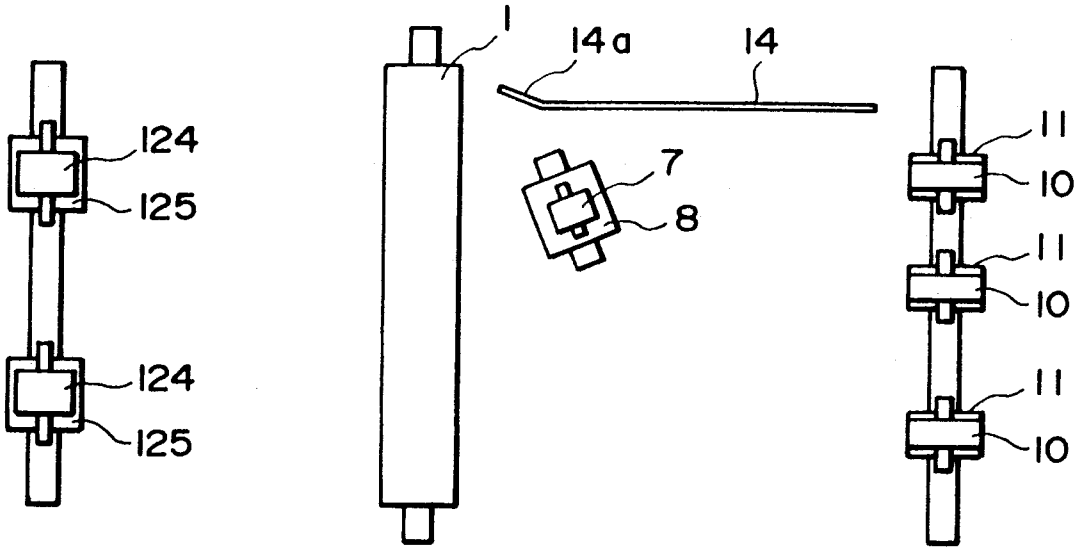
FIG. 2A shows a plan view of the present invention.
Figure 2B:
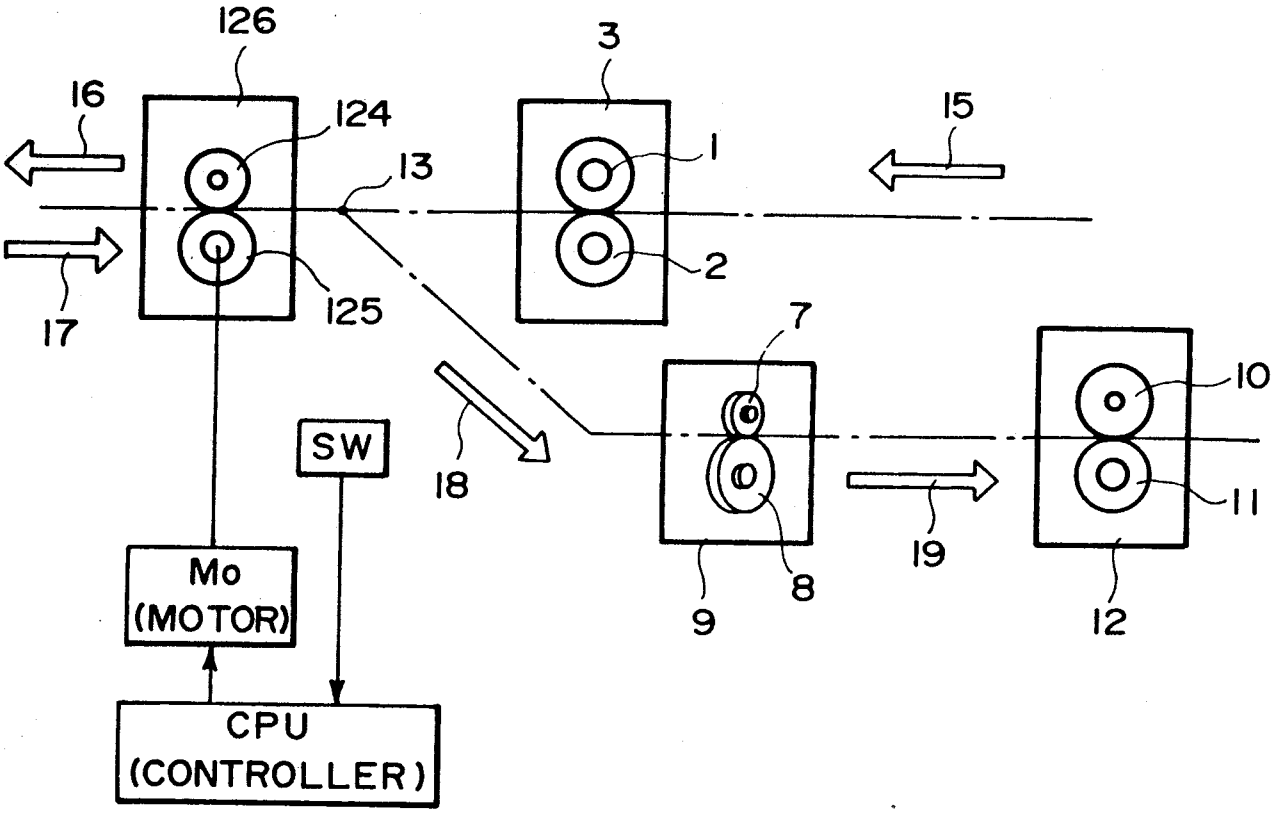
FIG. 2B shows a front view thereof.

FIGS. 2A and 2B show an embodiment of the present invention. Numeral 3 denotes a fixing unit comprising a heat roller 1 and a press roller 2, numeral 126 denotes a switch-back mechanism comprising reverse rollers 124 and 125, and numeral 9 denotes a skew roller mechanism comprising skew rollers 7 and 8. In the plan view of FIG. 2A, numeral 14 denotes a lateral registration plate defining a lateral registration reference plane, and numeral 12 denotes a refeed mechanism comprising refeed rollers 10 and 11.

A print sheet having an image transferred from a photosensitive body 28 (FIG. 6) onto a first surface thereof is fed in a direction of an arrow 15, and the image is fixed by the fixing unit 3. The reverse roller 125 feeds the print paper in a direction of an arrow 16 until a rear edge of the print sheet reaches a reversal point 13. When the rear edge of the print sheet reaches the reversal point (when a switch SW detects the rear edge), it reverses the feed direction (and a flop F is switched) so that the print sheet is fed in a direction of arrows 17 and 18. The switch SW flopper F together form a directing means.

Figure 3A:
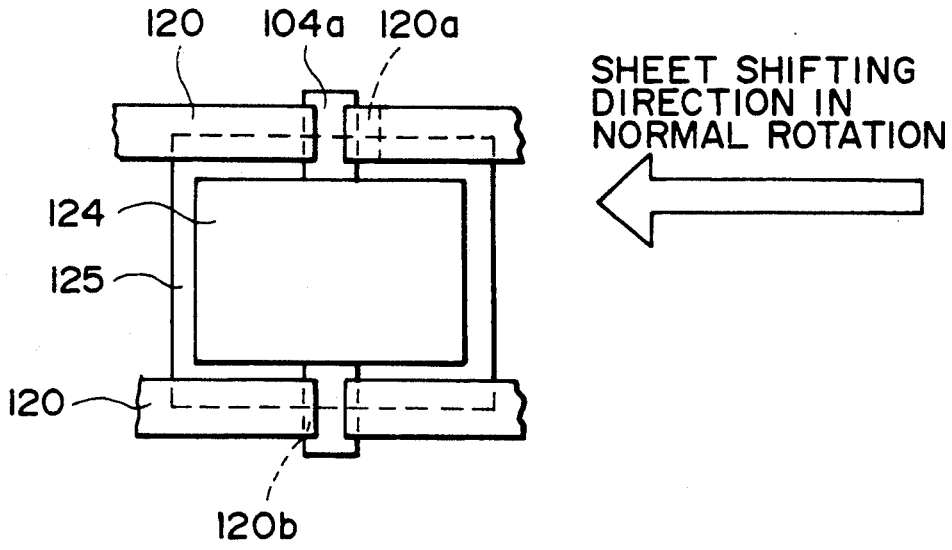
FIGS. 3A and 3B show a plan view and a front view of a switch-back mechanism used in the present invention.
Figure 3B:
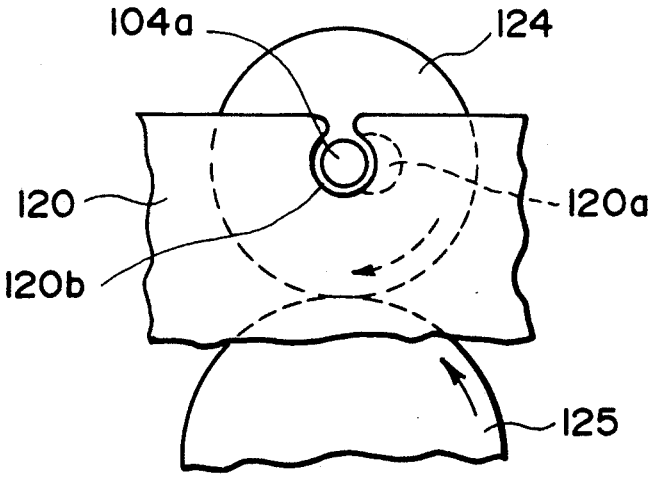
Figure 4A:
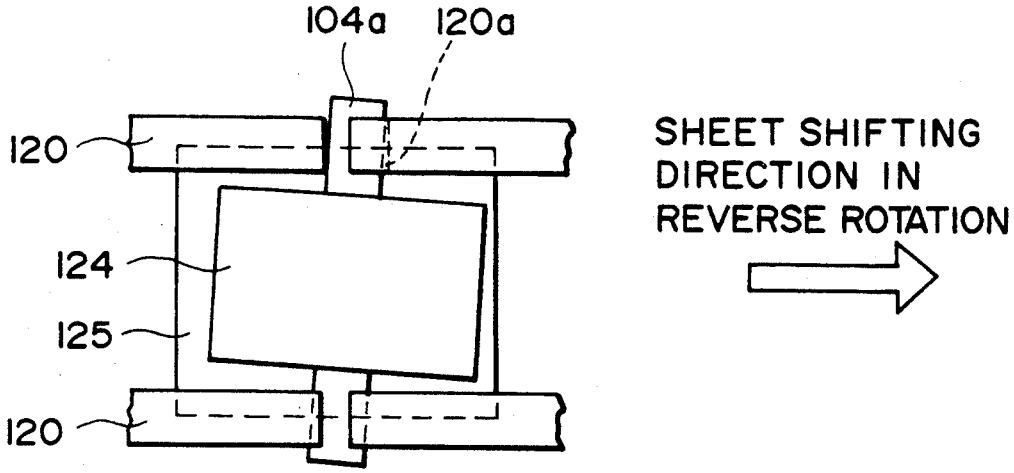
FIGS. 4A and 4B show a plan view and a front view for illustrating an operation of FIGS. 2A and 2B.
Figure 4B:
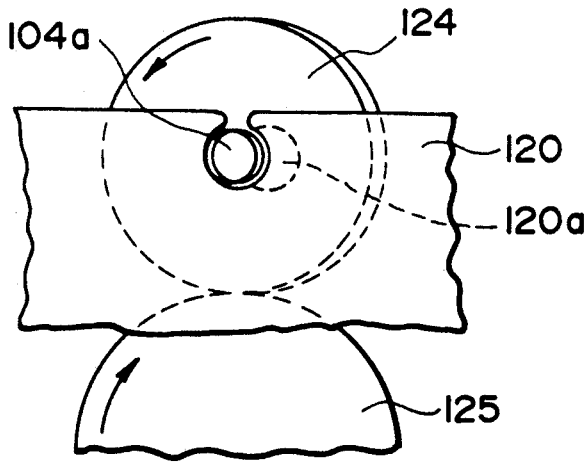

The switch-back mechanism 126 (which also functions as a preliminary shift mechanism) is now explained. As shown in FIGS. 3A, 3B; 4A and 4B, a play or gap 120*a* is provided in one of bearings of the reverse rollers 124. In a forward mode, axes of the reverse roller 124 (which is a follow roller and sides on the reverse roller 125 by its gravity) and the reverse roller 125 (which is a drive roller rotated by a motor) are orthogonal to the direction of the sheet feed and the print sheet is fed orthogonally to those axes. However, when the reverse roller 125 is in a reverse mode, the reverse roller 124 is skewed by an amount corresponding to the play formed in one bearing, by a friction to the print sheet, as shown in FIGS. 4A and 4B. The play 120*a* is formed in the bearing of the reverse roller facing the lateral registration plate so that the print sheet is skewed oppositely to the lateral registration plate. In this manner, the function of the preliminary shift mechanism is provided.

In the present embodiment, in order to shift a feed mode from a center reference feed to a side reference feed, a guide plate 14 is provided. If the lateral registration is effected in the center reference feed mode, the construction of the lateral registration roller would be complex (because the amount of registration must be changed in accordance with a sheet size).

Figure 5:
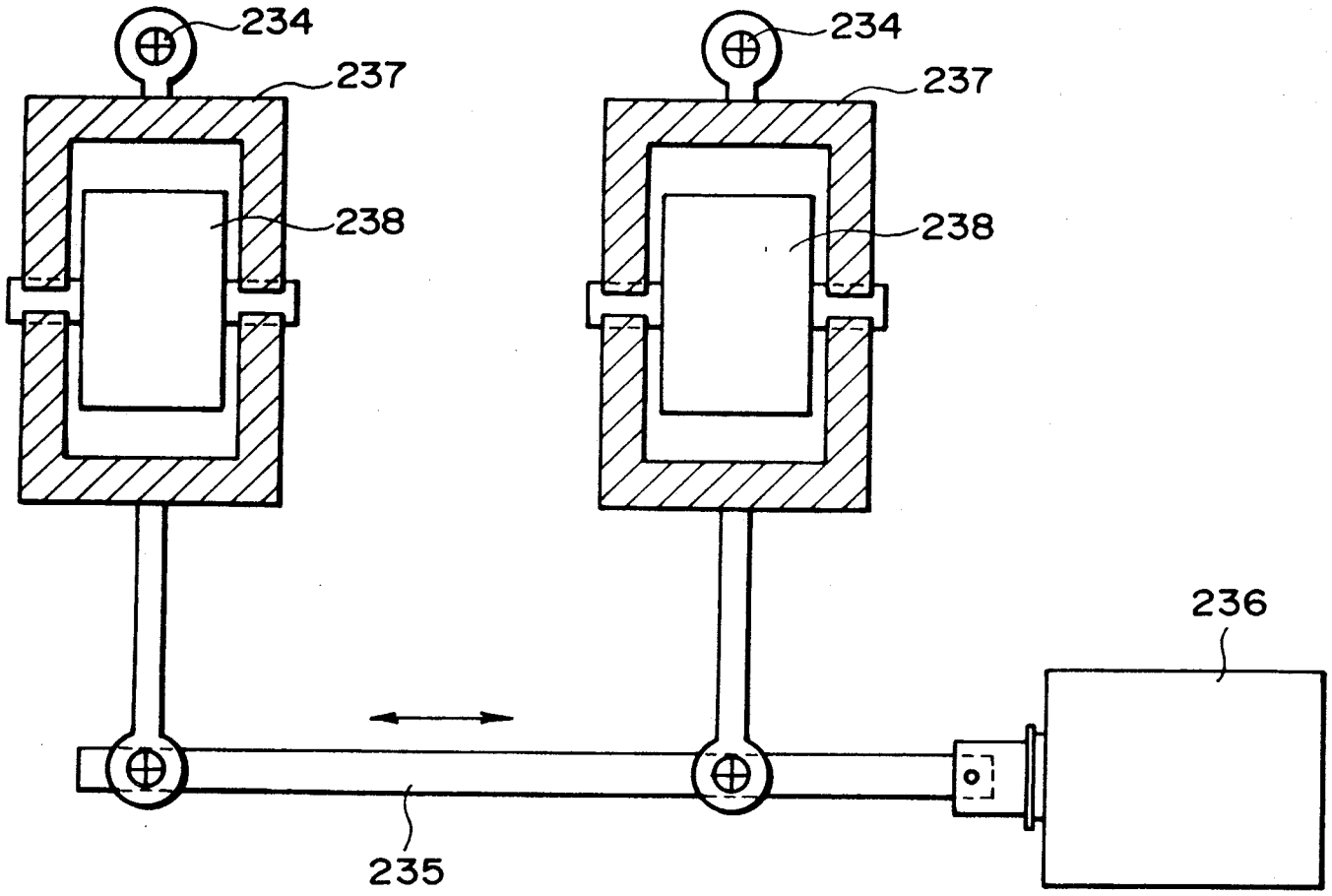
FIG. 5 shows a plan view of another embodiment.

FIG. 5 shows another embodiment of the present invention. A bracket 237 having a bearing for a reverse roller 238 is moved around a support point 234 by a solenoid 236 to skew the roller 238 in order to skew the print sheet. Numeral 235 denotes a link.

In the above embodiments, the guide plate is fixed. In FIGS. 7, 8, 9 and 10, the guide plate is movable so that the lateral registration is effected in the center reference feed mode.

Figure 7:
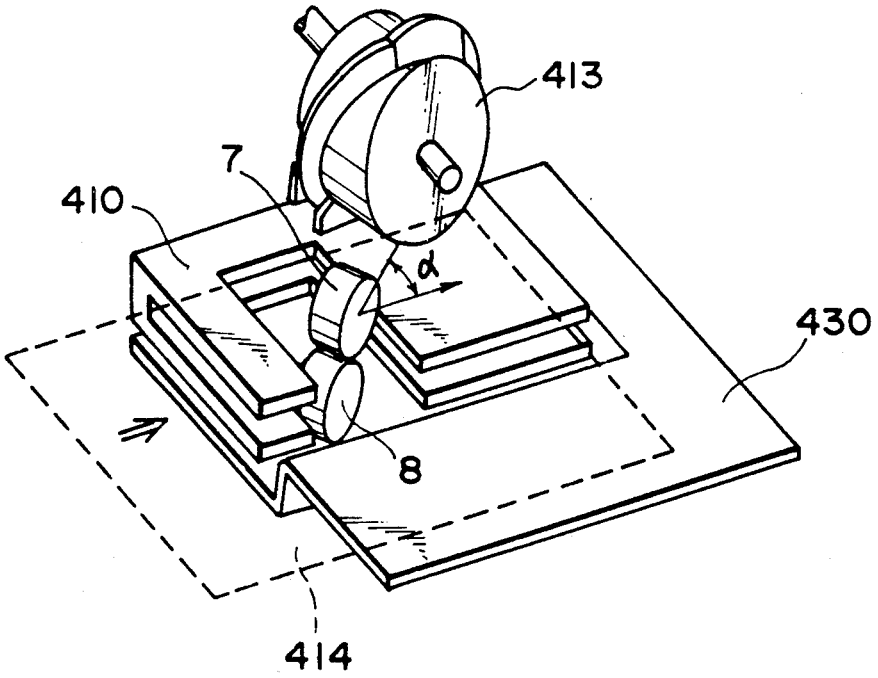
FIG. 7 shows a perspective view of other embodiment of a lateral registration unit.
Figure 8:
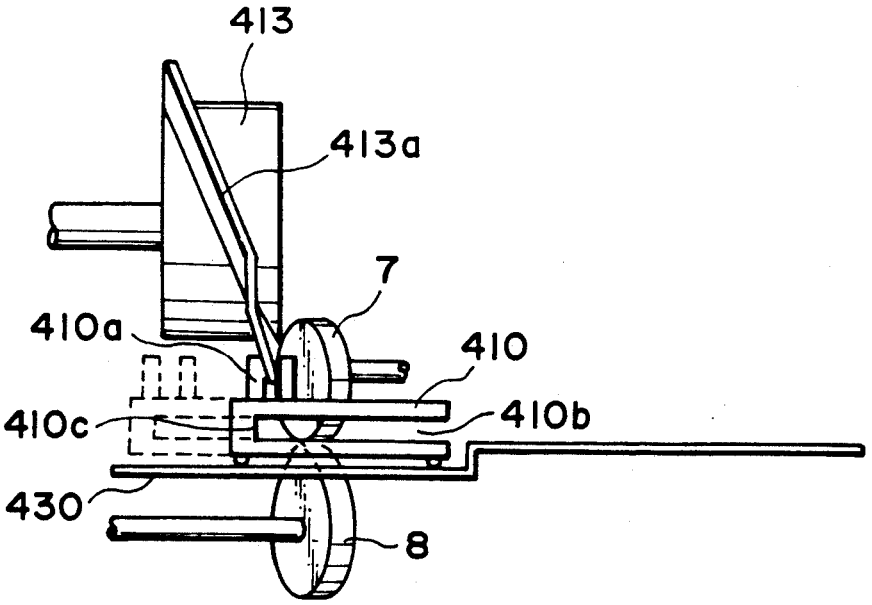
FIG. 8 shows a front view of the lateral registration unit of FIG. 7.
Figure 9:
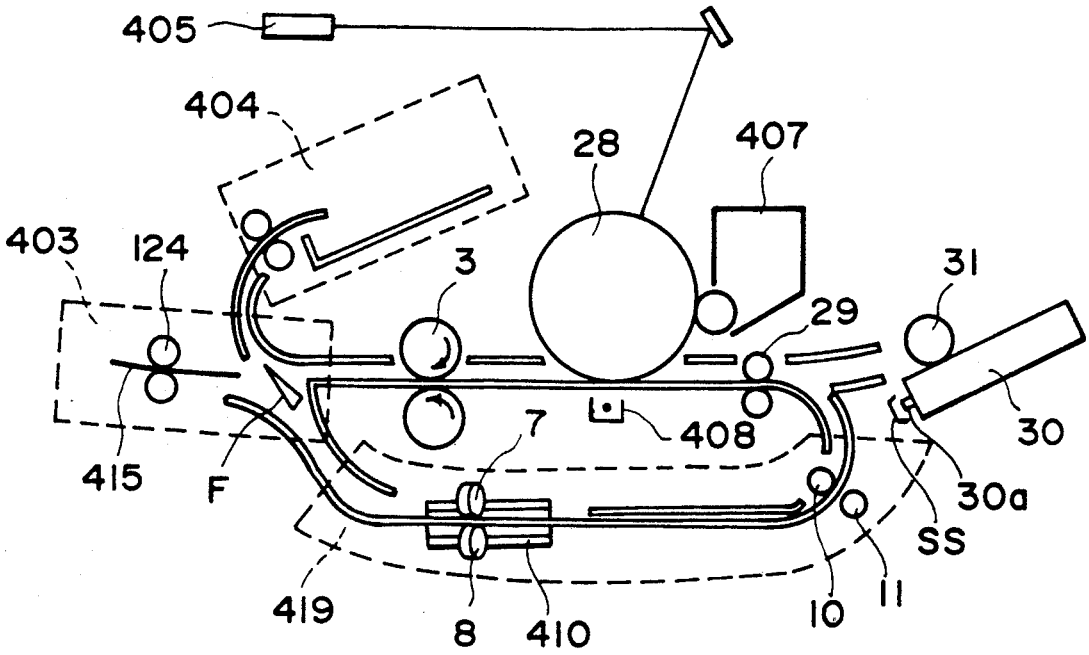
FIG. 9 shows a cross sectional view of an overall apparatus having the unit shown in FIGS. 7 and 8.
Figure 10:
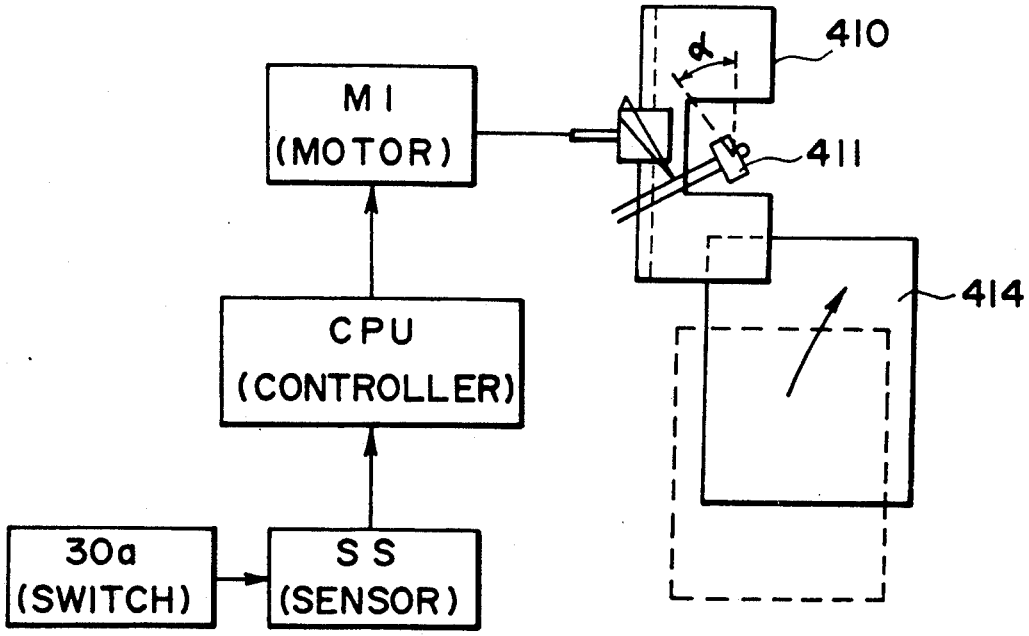
FIG. 10 shows a top view of the lateral registration unit of FIG. 7.

In both-surface printing, the sheet having an image fixed on one surface thereof by the fixing unit 3 is fed to a tray 415 and then guided to a both-surface feed path 419 by the reverse roller 124 and the flopper F, forming a directing means. FIGS. 7 and 8 show a lateral registration unit in the both-surface feed path 419. Numeral 410 denotes a lateral registration plate defining a lateral registration reference for the sheet. It is of U-shape and a side of the sheet is abutted against a side edge 410*c*. Numerals 7 and 8 denote skew rollers for skewing the sheet 414 so that it is abutted against the side edge 410*c*, and numeral 413 denotes a cam for moving the lateral registration plate to a predetermined position. It has a helical cam surface 413*a*. A sheet size identification member 30*a* of a cassette 30 is detected by a detector SS so that the lateral registration plate 410 is moved by the cam 413 on a guide plate 430 to a position corresponding to the sheet size. The cam 413 is rotated by an amount corresponding to the sheet size so that the cam surface 413*a* pushes a cam engagement 410*a* to slide the cam to the left or right. Accordingly, the sheet 414 is fed to the lateral registration plate in the direction shown in FIG. 10 without being jammed by the side of the lateral registration plate 410. The sheet guided to a groove 410*b* of the lateral registration plate is abutted against a side 410*c* of the lateral registration groove by the skew rollers 7 and 8 which tends to feed the sheet at an angle $\alpha$ with respect to the direction of feed of the sheet. In this manner, the lateral registration is effected.

As described above, the second run lateral registration of the sheet is attained by using a movable lateral registration plate in an image forming apparatus feeding the sheet in the center reference mode.

The center reference feed mode and the side reference feed mode are explained in detail with reference to an other embodiment.

Figure 11:
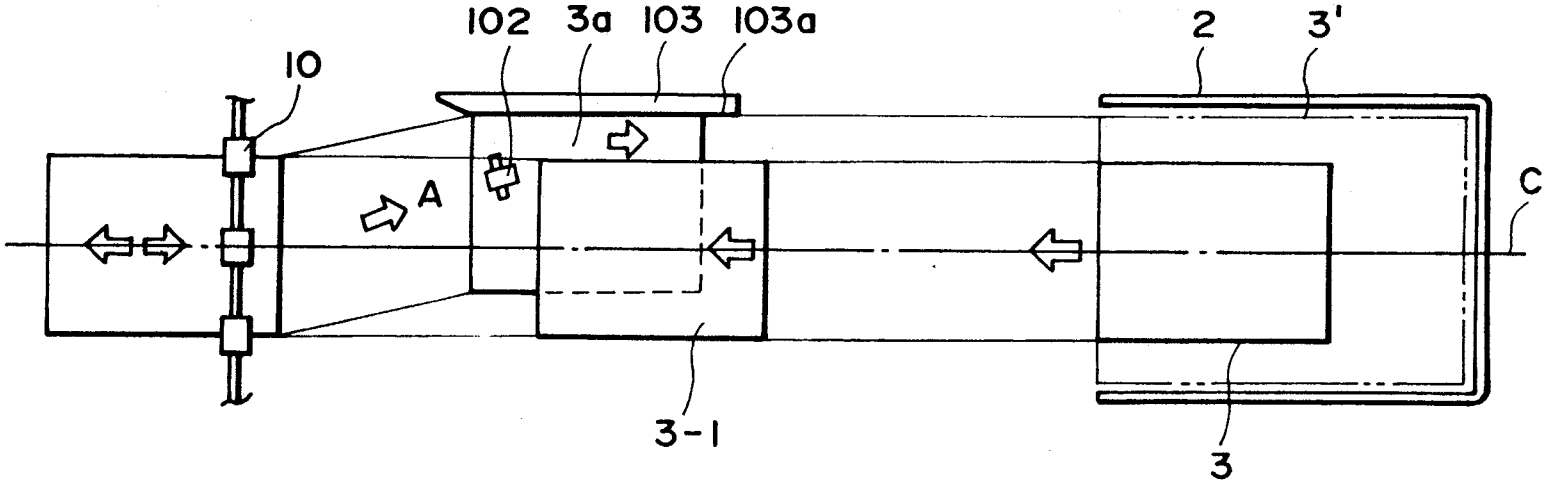
FIG. 11 shows a flow of a record sheet in a printer, as viewed from the top, when a center reference is aligned to a side reference.
Figure 12:
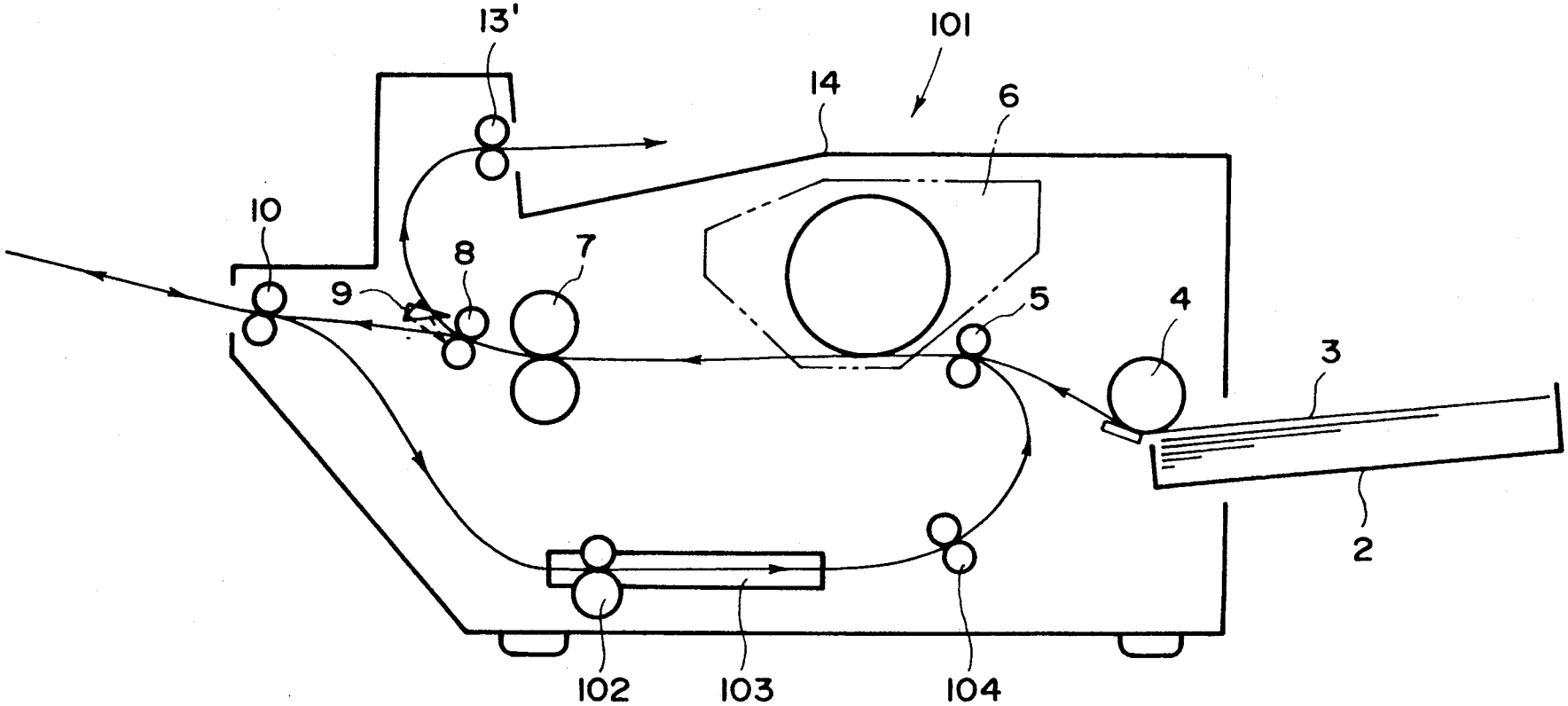
FIG. 12 shows a front view of a printer using the apparatus of FIG. 11.

FIG. 12 shows a printer which embodies the present invention. FIG. 11 shows a flow of the record sheet in the printer of FIG. 12, as viewed from the top.

Figure 6:
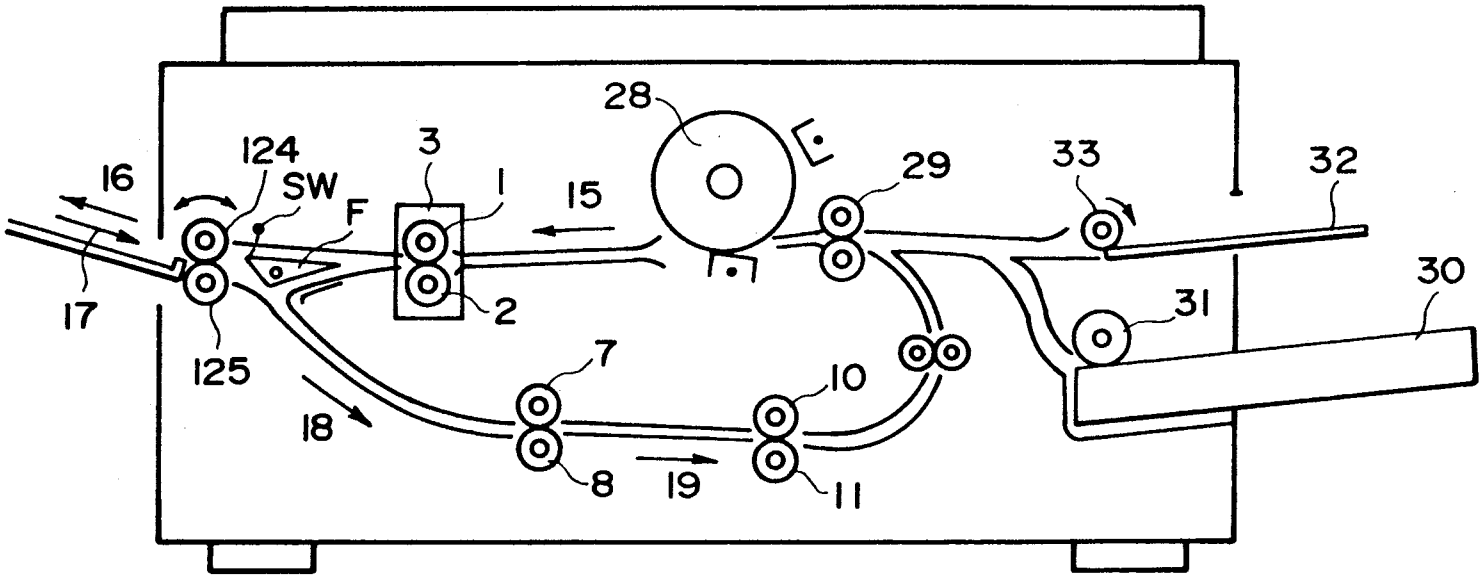
FIG. 6 shows a front view of a copying machine in accordance with the present invention.

In the printer 101 of FIG. 12, the construction from the sheet cassette 2 to the reverse roller 10 is the same as that of the printer of FIG. 6 and the description of the movement of the record sheet in that area is omitted.

The record sheet 3 switched back by the reverse roller 10 is fed to the skew roller 102, which is a feed roller inclined to the left with respect to the direction of feed of the record sheet 3. The lateral registration plate 103 is fixed on the left of the skew roller 102, and a reference plane 103*a* of the lateral registration plate 103 is aligned to an edge position 3' of a maximum possible width sheet used in the printer 101, as shown in FIG. 11. When the record sheet 3 is pinched by the skew roller 102, it is obliquely fed toward the lateral registration plate 103 as shown by an arrow A, and a left side edge 3*a* of the sheet abuts against the reference plane 103*a* of the lateral registration plate 103. The reference plane 103*a* is a lateral registration reference used when a second image of the printer 101 is recorded. The record sheet 3 is abutted against the reference plane 103*a* for the lateral registration. After the record sheet 3 has been laterally registered, it is further fed by the skew roller 102 along the reference plane 103*a*, fed to the registration roller 5, and the second image is recorded.

The difference between the lateral registration references when the first image is recorded and the second image is recorded is explained below in detail.

Figure 13:
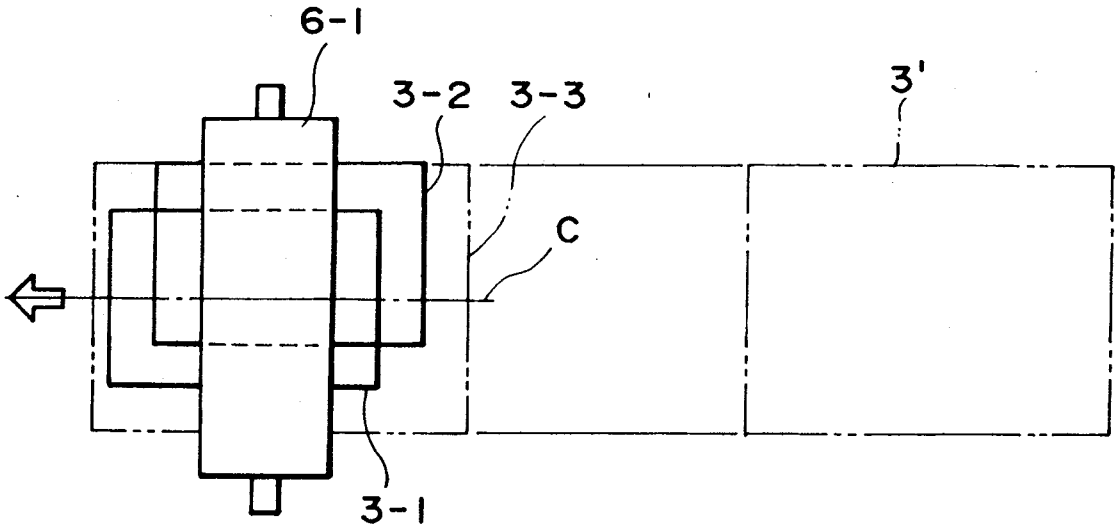
FIG. 13 shows a position of the record sheet when an image is recorded thereon.

The printer 101 feeds the sheet in the center reference feed mode. The record sheet 3 is fed from the cassette 2 to the reverse roller 10, as shown in FIG. 11, such that a center line (bisection line) C orthogonal to the direction of feed is common to all record sheet sizes. When the first image is recorded, the record sheet 3 receives the image at a position 3-1 of FIG. 13. FIG. 13 shows a positional relationship of the record sheet when the image is recorded on the photoconductor drum 6 of the recording unit 6. The record sheet is at the position 3-1. It is then laterally registered by the lateral registration plate 103 and has the second image recorded thereon. The record sheet 3 is fed to the recording unit 6 while the sheet edge 3*a* determined by the reference plane 103*a* is kept at the position of the sheet edge of the maximum width record sheet 3'. Accordingly, the second image is recorded at a position 3-2.

The situation is same even if the width of the record sheet changes. When the first image is recorded, the record sheet is positioned such that the center line C (bisection line orthogonal to the direction of feed) of the record sheet is aligned to the center line of the record sheet of different width (at the center reference position). When the second image is recorded, the record sheet is positioned such that the sheet edge on a specified side (left or right side with respect to the feed direction) of the record sheet is aligned to the sheet edge of the record sheet of different width (at a side reference position). In other words, when the first image is recorded, the record sheet is fed in the center reference feed mode, and when the second image is recorded, the record sheet is fed in the side reference feed mode.

In the above embodiment, a laser printer having a both-surface printing function is shown. The present invention is applicable not only to the record apparatus having the both-surface printing function, but also to a record apparatus having a multi-print function to record a plurality of images on one surface or a record apparatus having the both functions.

The recording system is not limited to an electrophotographic system but various recording systems may be used.

The record apparatus may be either a printer or a copying machine.

By arranging the lateral registration plate 103 on the same side as the lateral reference plane of the sheet cassette 2, the alignment of the references of the first and second images is improved For example, in FIG. 11, the lateral reference plane of the sheet cassette 2 is preferably on the left side with respect to the feed direction of the record sheet 3.

The sheet cassette 2 may be a sheet deck which can stack a number of cassettes.

As described hereinabove, in the recording apparatus for recording a plurality of images, when the first image is recorded, the record sheet is fed in the center reference feed mode, and when the second image is recorded, the record sheet is fed in the side reference feed mode Accordingly, the present recording apparatus offers the following advantages.

1. The lateral registration prior to the recording of the second image is effected by one lateral registration reference without regard to the size of the record sheet Accordingly, a mechanism to change the lateral registration reference position in accordance with the size of the record sheet is not necessary.

2. Since it is not necessary to change the lateral registration reference position, the lateral registration plate may be fixed. Accordingly, an adjustment tolerance due to a variation in the stop position of the reference position, which could not be avoided in the mechanism for changing the lateral registration position, is eliminated and high precision lateral registration is attained.

3. When the sheet is fed from the sheet cassette, it is fed in the center reference feed mode as is done in the conventional apparatus. Accordingly, the center reference feed mode which is simpler in the construction of the feed rollers than that of the side reference feed mode may be used as it is.

We claim:

1. A sheet material conveyer for an image forming apparatus, the conveyer having a sheet path for feeding a sheet back to an image forming unit after an image is formed on the set, comprising:

a switch-back mechanism for switching the direction of movement of the sheet on which the image is formed, and directing the sheet back to the sheet path;

a lateral registration abutment mechanism for abutting the switched-back sheet against a lateral registration reference plane of the mechanism; and a preliminary shift mechanism for shifting the sheet oppositely to the lateral registration reference plane;

said preliminary shift mechanism being shared by said switch-back mechanism.

2. A sheet conveyor according to claim 1, wherein the sheet material is fed in a center reference feed mode when a first image is recorded, and fed in the center reference feed mode again when a second image is recorded.

3. A sheet conveyer according to claim 2, wherein said abutment mechanism comprises:

a lateral registration plate for laterally registering a side edge of the sheet material arranged on a feed path of the sheet from the end of recording of the first image to the beginning of recording of the second image; and abutment means for abutting the sheet against said lateral registration plate;

said lateral registration plate being movable in accordance with the size of the sheet.

4. A sheet conveyor according to claim 1, wherein said switch-back mechanism includes a drive roller and a follow roller contacting with the drive roller, said follow roller having a pair of support bearings, and wherein a dimension of one of said support bearings for the follow roller is expanded along a feed direction of the sheet so that the sheet is skewed only in a reverse feed mode of the sheet.

5. A sheet conveyor according to claim 1, wherein said switch-back mechanism includes a drive roller and follow roller contacting with the drive roller, the roller roller is held by a swingable frame member which is electrically swung in the reverse feed mode of the sheet.

6. A sheet conveyer according to claim 1, wherein said sheet path is a multiple double-side path.

7. A sheet conveyer according to claim 1, wherein the sheet is fed in a center reference feed mode when a first image is recorded, and in a side reference feed mode when a second image is recorded.

8. A sheet material conveyer according to claim 1, wherein said lateral registration abutment mechanism is movable in accordance with the size of sheet.

9. A sheet conveyer according to claim 8 further comprising cam means adapted to be rotated in response to a sheet size signal, wherein the lateral registration plate is shifted in accordance with the rotation of the cam means.

10. A sheet conveyer for an image forming apparatus, the conveyer having a sheet path for feeding a sheet back to an image forming unit after an image is recorded on the sheet, comprising:

a switch-back mechanism for switching the direction of movement of the sheet on which the image is recorded, and directing the sheet back to the sheet path;

a lateral registration abutment mechanism for abutting the switched-back sheet against a lateral registration reference plane of the mechanism; and sheet convey means including a drive roller and a follow roller contacted to the drive roller, said follow roller having a pair of support bearings;

wherein a dimension of one of said support bearings for the follow roller is expanded along the feed direction of the sheet so that the sheet is skewed only in a reverse feed mode of the sheet.

11. A sheet material conveyer for an image forming apparatus, the conveyer having a sheet path for feeding a sheet back to an image forming unit after an image is recorded on the sheet, comprising:

a switch-back mechanism for switching the direction of movement of the sheet on which the image is formed, and directing the sheet back to the sheet path;

a preliminary shift mechanism for shifting the sheet in a first lateral direction;

a lateral registration abutment mechanism for moving said sheet in a second direction opposite to said first direction and for abutting the switched-back sheet against a lateral registration reference plane of the mechanism;

wherein the sheet is fed in a center reference feed mode when a first image is recorded, and the sheet is fed in a side reference mode when a second image is recorded by operation of said switch-back mechanism, preliminary shift mechanism and abutment mechanism.

12. A sheet material conveyer according to claim 11, wherein said preliminary shift mechanism is shared with said switch-back mechanism.

13. A sheet conveyer for an image forming apparatus, the conveyer having a sheet path for feeding a sheet back to an image forming unit after an image is recorded on the sheet, comprising:

a directiong means for directing the sheet on which the image is recorded to the sheet path;

a lateral registration abutment mechanism for abutting the directed sheet against a lateral registration reference plane of the mechanism; and sheet convey means including a drive roller and a follow roller contacted to the drive roller, said follow roller having a pair of support bearings;

wherein a dimension of one of said support bearings for the follow roller is expanded along the feed direction of the sheet so that the sheet is skewed along in a reverse feed mode of the sheet.

14. A sheet material conveyer for an image forming apparatus, the conveyer having a sheet path for feeding a sheet back to an image forming unit after an image is recorded on the sheet, comprising:

a directing means for directing the sheet on which the image is formed to the sheet path;

a preliminary shift mechanism for shifting the sheet in a first lateral direction; and a lateral registration abutment mechanism for moving said sheet in a second direction opposite to said first direction and for abutting the directed sheet against a lateral registration reference plane of the mechanism;

wherein the sheet is fed in a center reference feed mode when a first image is recorded, and the sheet is fed in a side reference mode when a second image is recorded by operation of said direction means, preliminary shift mechanism and abutment mechanism.

15. An image forming apparatus with a sheet material conveyer having a sheet path for feeding a sheet back to an image forming unit after an image is formed on the sheet, comprising:

a switch-back mechanism for switching the direction of movement of the sheet on which the image is formed, and directing the sheet back to the sheet path;

a lateral registration abutment mechanism for abutting the switched-back sheet against a lateral registration reference plane of the mechanism; and a preliminary shift mechanism for shifting the sheet oppositely to the lateral registration reference plane, said preliminary shift mechanism being shared by said switch-back mechanism.

16. A image forming apparatus with a sheet conveyer having a sheet path for feeding a sheet back to an image forming unit after an image is recorded on the sheet, comprising:

a switch-back mechanism for switching the direction of movement of the sheet on which the image is recorded, and directing the sheet back to the sheet path;

a lateral registration abutment mechanism for abutting the switched-back sheet against a lateral registration reference plane of the mechanism; and sheet convey means including a drive roller and a follow roller contacted to the drive roller, said follow roller having a pair of support bearings;

wherein a dimension of one of said support bearings for the follow roller is expanded along the feed direction of the sheet so that the sheet is skewed only in a reverse feed mode of the sheet.

17. An image forming apparatus with a sheet material conveyer having a sheet path for feeding a sheet back to an image forming unit after an image is recorded on the sheet, comprising:

a switch-back mechanism for switching the direction of movement of the sheet on which the image is formed, and directing the sheet back to the sheet path;

a preliminary shift mechanism for shifting the sheet in a first lateral direction; and a lateral registration abutment mechanism for moving said sheet in a second direction opposite to said first direction and for abutting the switched-back sheet against a lateral registration reference plane of the mechanism;

wherein the sheet is fed in a center reference feed mode when a first image is recorded, and the sheet is fed in a side reference mode when a second image is recorded by operation of said switch-back mechanism, preliminary shift mechanism and abutment mechanism.

18. An image forming apparatus with a sheet conveyer having a sheet path for feeding a sheet back to an image forming unit after an image is recorded on the sheet, comprising:

a directing means for directing the sheet on which the image is recorded to the sheet path;

a lateral registration abutment mechanism for abutting the directed sheet against a lateral registration reference plane of the mechanism; and sheet convey means including a drive roller and a follow roller contacted to the drive roller, said follow roller having a pair of support bearings;

wherein a dimension of one of said support bearings for the follow roller is expanded along the feed direction of the sheet so that the sheet is skewed only in a reverse feed mode of the sheet.

19. An image forming apparatus with a sheet material conveyer having a sheet path for feeding a sheet back to an image forming unit after an image is recorded on the sheet, comprising:

a directing means for directing the sheet on which the image is formed to the sheet path;

a preliminary shift mechanism for shifting the sheet in a first lateral direction; and a lateral registration abutment mechanism for moving said sheet in a second direction opposite to said first direction and for abutting the directed sheet against a lateral registration reference plane of the mechanism;

wherein the sheet is fed in a center reference feed mode when a first image is recorded, and the sheet is fed in a side reference mode when a second image is recorded by operation of said directing means, preliminary shift mechanism and abutment mechanism.

* * * * *

UNITED STATES PATENT AND TRADEMARK OFFICE

CERTIFICATE OF CORRECTION

PATENT NO. : 5,162,857

DATED : November 10, 1992

INVENTOR(S) : HIGETA, et al.

It is certified that error appears in the above-identified patent and that said Letters Patent is hereby corrected as shown below:

COLUMN 1

Line 30, "surface" should read --surface.--.
Line 39, "jam" should read --jammed--.

COLUMN 5

Line 58, "set," should read --sheet,--.

COLUMN 7

Line 36, "along" should read --only--.
Line 53, "direction" should read --directing--.

COLUMN 8

Line 3, "A" should read --An--.

Signed and Sealed this

Sixteenth Day of November, 1993

Bruce Lehman

*Attest:*

BRUCE LEHMAN

*Attesting Officer*

*Commissioner of Patents and Trademarks*